US010125987B2

(12) United States Patent
Tonon et al.

(10) Patent No.: US 10,125,987 B2
(45) Date of Patent: Nov. 13, 2018

(54) DAMPER OF A GAS TURBINE WITH A GAP

(71) Applicant: ANSALDO ENERGIA SWITZERLAND AG, Baden (CH)

(72) Inventors: Devis Tonon, Turgi (CH); Mirko Ruben Bothien, Zürich (CH)

(73) Assignee: ANSALDO ENERGIA SWITZERLAND AG, Baden (CH)

( * ) Notice: Subject to any disclaimer, the term of this patent is extended or adjusted under 35 U.S.C. 154(b) by 288 days.

(21) Appl. No.: 14/958,386

(22) Filed: Dec. 3, 2015

(65) Prior Publication Data

US 2016/0161118 A1 Jun. 9, 2016

(30) Foreign Application Priority Data

Dec. 3, 2014 (EP) ..... 14196051

(51) Int. Cl.
*F23M 3/00* (2006.01)
*F23M 20/00* (2014.01)
*F23R 3/00* (2006.01)

(52) U.S. Cl.
CPC ..... *F23M 20/005* (2015.01); *F23R 3/002* (2013.01); *F23R 2900/00014* (2013.01)

(58) Field of Classification Search
CPC ..... F23R 2900/00014; F23R 3/002; F23M 20/005; F05D 2260/963; F05D 2260/964
See application file for complete search history.

(56) References Cited

U.S. PATENT DOCUMENTS 7,104,065 B2 * 9/2006 Benz ..... F23R 3/002 60/725
7,311,175 B2 * 12/2007 Proscia ..... F01D 25/30 181/214
7,448,215 B2 * 11/2008 Macquisten ..... F23M 20/005 181/220
7,857,094 B2 * 12/2010 Macquisten ..... F23R 3/002 60/725
2004/0248053 A1 * 12/2004 Benz ..... F23R 3/002 431/114

(Continued)

FOREIGN PATENT DOCUMENTS

EP 1 669 670 A1 6/2006
EP 1 862 739 A3 12/2007

OTHER PUBLICATIONS

Extended European Search Report dated May 18, 2015, by the European Patent Office in corresponding European Patent Application No. 14196051.8-1602. (7 pages).

*Primary Examiner* — Carlos A Rivera
(74) *Attorney, Agent, or Firm* — Buchanan Ingersoll & Rooney PC

(57) ABSTRACT

A damper for a gas turbine combustion chamber as shown in FIG. 1 includes a damper volume wall and a main neck. The damper volume wall defines a damper volume inside the damper volume wall. The main neck includes a main neck wall defining a main neck volume inside the main neck wall. The main neck is associated with the damper volume for fluid communication between the damper volume and the gas turbine combustion chamber. In addition, the damper includes a gap between the main neck wall and the damper volume wall. The main neck defines a main neck axis. For example, the gap is a second neck, and in further embodiments, multiple damper volumes are provided.

12 Claims, 2 Drawing Sheets

(56) References Cited

U.S. PATENT DOCUMENTS

| | | | | |
|---|---|---|---|---|
| 2006/0123791 | A1 | 6/2006 | MacQuisten et al. | |
| 2008/0066999 | A1* | 3/2008 | Kostun | F02M 35/1222 181/250 |
| 2008/0087019 | A1 | 4/2008 | MacQuisten et al. | |
| 2011/0048018 | A1* | 3/2011 | Schnell | F23R 3/002 60/722 |
| 2011/0265484 | A1* | 11/2011 | Huber | F23R 3/002 60/755 |
| 2011/0308654 | A1* | 12/2011 | Bothien | F23M 99/005 138/31 |
| 2014/0053559 | A1* | 2/2014 | Maurer | F23R 3/002 60/725 |
| 2015/0047357 | A1* | 2/2015 | Schuermans | F23R 3/002 60/725 |

* cited by examiner

A - A 10
12
14
16
18
20
22
24
26
30
32
33
34
36
40
41
42
43
A

DAMPER OF A GAS TURBINE WITH A GAP

TECHNICAL FIELD

This invention relates to dampers for gas turbines, and particularly to dampers for gas turbines where the main neck and the damper volume wall are not connected.

BACKGROUND OF THE INVENTION

In existing gas turbines, dampers (or Helmholtz dampers) are normally provided to reduce pulsations and vibrations within the gas turbine combustion chamber. These dampers provide a damper volume attached to the combustion chamber by a damper neck. However, this arrangement has the drawback that the neck and the mechanical connections holding the damper in place need to be designed to tolerate thermal expansions and thermal loads. This requires extra complexity and expense in damper design and manufacture. We have therefore appreciated that it would be desirable to provide an improved damper design.

SUMMARY OF THE INVENTION

The invention is defined in the appended independent claims to which reference should now be made. Advantageous features of the invention are set forth in the dependent claims.

A first aspect of the invention provides a damper for a gas turbine combustion chamber, comprising a damper volume wall defining a damper volume inside the damper volume wall, and a main neck, the main neck comprising a main neck wall defining a main neck volume inside the main neck wall, and the main neck being associated with the damper volume for fluid communication between the damper volume and the gas turbine combustion chamber, the damper further comprising a gap between the main neck wall and the damper volume wall. As a result, the damper neck (the main neck connected to the combustion chamber) is mechanically disconnected from the rest of the damper structure. This allows for independent thermal expansion and movement of the damper neck together with the combustion chamber wall independently of the damper structure. As the damper neck and combustion chamber are in an area subject to high temperatures and the damper volume is in an area subjected to comparatively lower temperatures, this allows for independent thermal movement in these components without structural stress.

In one embodiment, the damper additionally comprises a second damper volume wall defining a second damper volume arranged outside the main neck wall, and the second neck is for fluid communication between the first damper volume and the second damper volume. This is more space efficient than previous designs, since the necks are arranged around each other.

In another embodiment, the gap and the main neck are coaxial. In another embodiment, the gap is disposed adjacent to the main neck. In another embodiment, the full circumference of the main neck is surrounded by the gap.

In another embodiment, a purge air hole is provided for providing a fluid to the second damper volume. This improves the damping performance of the damper, and allows the damper to be cooled.

In another embodiment, the gap is partly defined by a flange.

In another embodiment, a combustion chamber comprising the damper described above is provided. Preferably, the main neck is connected to a wall of the combustion chamber. Preferably, the first volume wall is connected to the combustion chamber. Preferably, the first volume wall is connected to the combustion chamber at a point distal from the main neck.

In another embodiment, a gas turbine is provided, comprising a damper as described above or a combustion chamber as described above.

A second aspect of the invention comprises a method of operating a gas turbine, according to any of the apparatus described above, the method comprising the step of feeding purging fluid through a gap between the main neck wall and the damper volume wall. In an embodiment, the method additionally comprises feeding the purging fluid through the main neck from the damper volume into the combustion chamber. In another embodiment, the method comprises the additional step of feeding purging fluid through a purge hole into the second damper volume. In another embodiment, the purging fluid is a cooling fluid such as air.

BRIEF DESCRIPTION OF THE DRAWINGS

An embodiment of the invention will now be described by way of example only and with reference to the accompanying drawings in which.

DETAILED DESCRIPTION OF THE PREFERRED EMBODIMENTS

Figure 1:
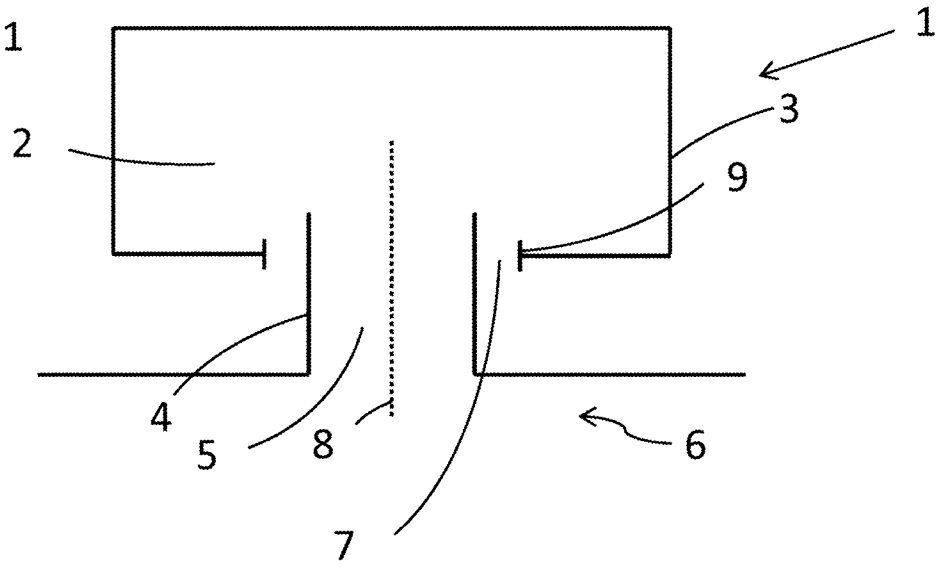
FIG. 1 shows a cross-section side view of a damper according to the invention.

A damper 1 for a gas turbine combustion chamber as shown in FIG. 1 comprises a damper volume wall 3 and a main neck. The damper volume wall 3 defines a damper volume 2 inside the damper volume wall 3. The main neck comprises a main neck wall 4 defining a main neck volume 5 inside the main neck wall 4. The main neck is associated with the damper volume 2 for fluid communication between the damper volume 2 and the gas turbine combustion chamber 6. In addition, the damper comprises a gap 7 between the main neck wall 4 and the damper volume wall 3. Optionally, a flange 9 is provided to delineate the gap 7. The main neck defines a main neck axis 8. Preferably, the gap 7 is a second neck.

Figures 2, 3, 4:
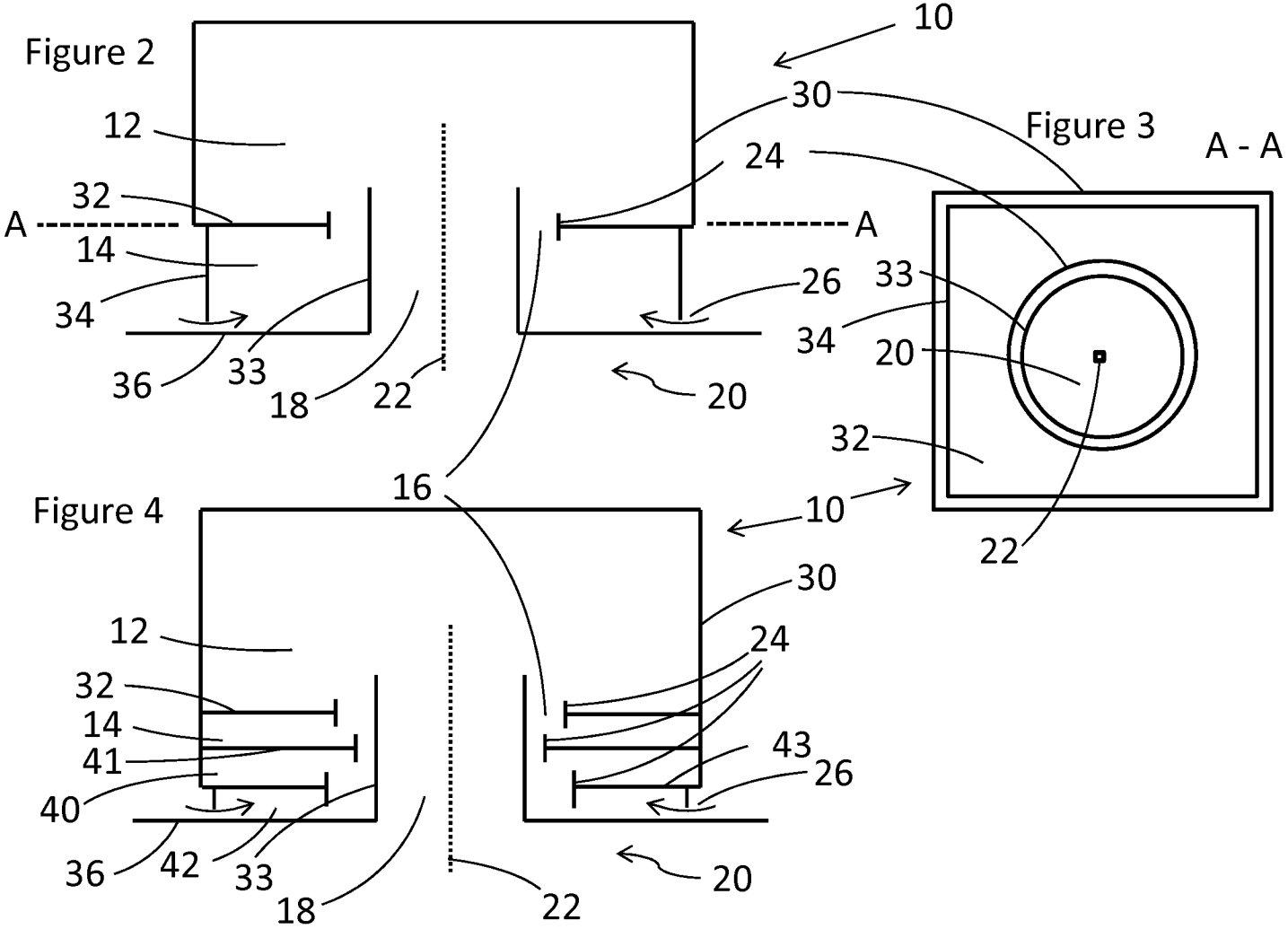
FIG. 2 shows a cross-section side view of a damper according to an embodiment of the invention.
FIG. 3 shows a cross-section top view of the damper of FIG. 2.
FIG. 4 shows a cross-section side view of a damper according to a second embodiment of the invention.

A damper 10 as shown in FIG. 2 consists of a damper volume 12 (a first volume) and a second damper volume 14, connected by a second neck 16 (or intermediate neck) for fluid communication between the damper volume and the second damper volume. A main neck 18 connects the damper volume 12 with the combustion chamber 20. The main neck 18 defines a main neck axis 22. The second neck 16 is disposed around the main neck such that at least a portion of the second neck 16 is disposed radially outside the main neck 18 with respect to the main neck axis 22. Optionally, a flange 24 is provided to delineate the second neck 16. Optionally, a purge hole 26 is provided through which a fluid such as air can circulate.

In the embodiment shown in FIG. 2, damper volume 12 is substantially surrounded by outer damper wall 30. A secondary wall 32 separates the damper volume 12 from the second damper volume 14, thereby delineating part of the damper volume 12. The second damper volume in this example is delineated by the secondary wall 32, the main neck wall 33, a secondary outer damper wall 34, and a combustion chamber wall 36. These structural elements are merely exemplary, and various other structural possibilities are available, some of which are explained in more detail below.

FIG. 3 shows the same features as FIG. 2, but from a top view. This is shown merely as an example, and many different shapes are possible for the various features shown. Some examples of alternative shapes are mentioned below.

FIG. 4 shows an alternative embodiment, including most of the features of FIG. 2. In this alternative embodiment, a third damper volume 40, a tertiary wall 41, a fourth damper volume 42 and a quaternary wall 43 are included, along with optional flanges 24.

In FIGS. 1 and 2, specific sets of walls are described limiting the damper and second damper volumes. This is merely an exemplary arrangement, and various different structural arrangements are envisioned. For example, part of the outer damper wall 3, 30 may be provided by other features of the gas turbine rather than by these bespoke damper parts.

The damper 1, 10 and damper volume 2, 12 may be a wide variety of shapes and sizes, such as the substantially cuboid structures shown in the Figures, a substantially semi spheroid shape, or any other appropriate regular or irregular shape. In most cases, the design will be driven by the requirement to fit within available spaces around the combustion chamber within a gas turbine, and will therefore follow the contours of the combustion chamber and/or other features within the gas turbine. The design may also depend on which damping modes need damping. A similar variety of shapes is possible for the other volumes provided within the damper.

Although two damper volumes 12 and 14 are shown in FIG. 2 and four damper volumes 12, 14, 40 and 42 are shown in FIG. 4, three, five or more damper volumes can also be included. This results in a plurality of intermediate necks around the main neck (second neck, third neck, fourth neck, etc.).

Various different arrangements of features are possible to delineate the second damper volume 14. For example, in the case shown in FIG. 2, a secondary outer damper wall (or second damper volume wall) 34 is provided, partially defining the second damper volume 14, but in some cases (such as the embodiment of FIG. 4) the outer damper wall 30 and/or a tertiary wall 41 would extend to surround the second damper volume as well. Flanges delineating intermediate necks may help define the extent of the second damper volume, as may other structural features. Similar variety of delineation structures is possible for third, fourth and subsequent damper volumes.

The main neck 18 provides fluid communication between the damper volume and the combustion chamber, and is not connected directly to the other features of the damper. The main neck typically has an exit into the combustion chamber at one end and an exit into the damper volume at the other end. The main neck is shown as cylindrical and perpendicular to the combustion chamber wall in the Figures, but may be another shape, such as a cuboid or an irregular shape. Generally the axis of the main neck will be substantially perpendicular to the combustion chamber wall. The main neck is also not necessarily completely straight, in which case the main neck axis would preferably be defined as perpendicular to the cross-sectional plane across the main neck at the point where the main neck enters the combustion chamber.

The second or intermediate neck 7, 16 is disposed around the main neck, so that the second neck is outside the main neck. The intermediate necks are shown as cylindrical in the Figures, but may be another shape, such as a cuboid or an irregular shape. Preferably, each intermediate neck entirely surrounds the main neck, going around its full circumference. Although the examples in the Figures show the intermediate necks adjacent to the main neck, this is not essential and the intermediate neck could be separated from the main neck, for example by placing the intermediate neck part way along the secondary wall 32 of FIGS. 2 and 4. The entire secondary wall could be between the intermediate neck and the main neck. Where multiple intermediate necks are provided (second neck, third neck, fourth neck), the necks can be of different widths (with the width being the distance between the main neck wall and the secondary wall or flange) and can also be different distances from the main neck. As the damper resonance frequency is dependent on (amongst other things) the neck width, it is possible to modify the damping performance by modifying the neck width.

Preferably, in any given radial direction, the intermediate neck (or gap) is disposed further from the main neck axis than the main neck. Preferably, when looking at a cross-section of the damper, the intermediate neck and the main neck lie within the same plane, the plane being perpendicular to the main neck axis; in other words, the plane includes a full cross-section of both the intermediate neck and the main neck.

The main and intermediate necks are optionally coaxial and/or concentric. In some embodiments, the main and intermediate necks have parallel axes.

The intermediate necks in the Figures are shown adjacent to the main neck, but as mentioned above this is not necessarily the case. The main requirement is that the intermediate neck should normally be as close to the combustion chamber as the main neck. At the least, the part of the intermediate neck closest to the combustion chamber should be closer to the combustion chamber than the part of the main neck furthest from the combustion chamber.

Necks have a cross-sectional area and a length, as is typical in Helmholtz dampers. The area and length define a damping frequency when combined with a volume. Extra dampers could be stacked on the damper of the current invention, either dampers according to the current invention or conventional dampers. These dampers would be attached distal to the combustion chamber.

The damper could be related to any part of the combustion chamber 6, 20.

A flange 24 is preferably provided to delineate the intermediate neck. This provides options in defining the neck length and therefore the damping frequency.

The gap 7 in FIG. 1 separates the main neck and the damper volume wall so that the main neck and the damper volume wall are not touching. The gap can be used to circulate purge air through the damper. The gap 26 (or purge hole) as shown in FIGS. 2 and 4 is provided to allow a fluid such as air to circulate, typically through the intermediate neck or necks and the main neck to the combustion chamber. This fluid may be a cooling fluid. In some embodiments, the damper volume part (the parts of the damper not including the main neck) is completely separated from the combustion chamber, and the damper volume part is attached to another part of the gas turbine. In other embodiments, the damper volume part is connected to the combustion chamber and a gap or gaps can be provided for purge air, preferably at a point distal from the main neck. Preferably, the gap and the intermediate necks are arranged such that a fluid such as air circulates past the combustion chamber wall. Preferably, the gap and the intermediate necks are arranged such that a fluid such as air circulates past the main neck wall, most preferably past the part of the main neck wall proximate the combustion chamber. The gap would preferably be provided to allow a fluid to enter into a volume closest to or adjacent to the combustion chamber.

In a method of operating a gas turbine comprising the apparatus described above, purging fluid is fed through a gap 7 between the main neck wall 4 and the damper volume wall 3. It may subsequently be fed through the main neck from the damper volume 2 into the combustion chamber 6. In embodiments with a second damper volume, the method comprises the additional step of feeding purging fluid through a purge hole 26 into the second damper volume.

Various modifications to the embodiments described are possible and will occur to those skilled in the art without departing from the invention which is defined by the following claims.

| REFERENCE SIGNS | |
|---|---|
| 1 | damper |
| 2 | damper volume |
| 3 | damper volume wall |
| 4 | main neck wall |
| 5 | main neck volume |
| 6 | combustion chamber |
| 7 | gap or second neck (intermediate neck) |
| 8 | main neck axis |
| 9 | flange |
| 10 | damper |
| 12 | damper volume |
| 14 | second damper volume |
| 16 | second neck (intermediate neck) |
| 18 | main neck |
| 20 | combustion chamber |
| 22 | main neck axis |
| 24 | flange |
| 26 | purge hole |
| 30 | outer damper wall |
| 32 | secondary wall |
| 33 | main neck wall |
| 34 | secondary outer damper wall |
| 36 | combustion chamber wall |
| 40 | third damper volume |
| 41 | tertiary wall |
| 42 | fourth damper volume |
| 43 | quaternary wall |

The invention claimed is:

1. A damper for a gas turbine combustion chamber, comprising:

a damper volume wall defining a damper volume inside the damper volume wall;

a main neck, the main neck including a main neck wall defining a main neck volume inside the main neck wall, and the main neck being associated with the damper volume for fluid communication between the damper volume and a combustion chamber, wherein the main neck is mechanically connected to a wall of the combustion chamber; and a gap between the main neck wall and the damper volume wall, such that the main neck is mechanically disconnected from the damper volume wall by the gap.

2. The damper of claim 1, wherein comprising:

a second damper volume wall defining a second damper volume arranged outside the main neck wall; and a second neck for fluid communication between the first damper volume and the second damper volume.

3. The damper of claim 1, wherein the gap and the main neck are coaxial.

4. The damper of claim 1, wherein the gap is disposed adjacent to the main neck.

5. The damper of claim 1, wherein the full circumference of the main neck is surrounded by the gap.

6. The damper of claim 2, comprising: a purge hole for providing a fluid to the second damper volume.

7. The damper of claim 1, wherein the gap is partly defined by a flange.

8. A combustion chamber comprising the damper of claim 1.

9. A gas turbine comprising the damper of claim 1.

10. A method of operating a gas turbine, the gas turbine having a damper, the damper having a damper volume wall defining a damper volume inside the damper volume wall, and a main neck, the main neck having a main neck wall defining a main neck volume inside the main neck wall, and the main neck being associated with the damper volume for fluid communication between the damper volume and a combustion chamber of the gas turbine, the main neck mechanically connected to a wall of the combustion chamber, the damper including a gap between the main neck wall and the damper volume wall, such that the main neck is mechanically disconnected from the damper volume wall by the gap, the method comprising:

feeding a purging fluid through the gap between the main neck wall and the damper volume wall.

11. The method of claim 10, comprising: feeding the purging fluid through the main neck from the damper volume into the combustion chamber.

12. The method of claim 10, wherein the damper additionally includes a second damper volume wall defining a second damper volume arranged outside the main neck wall, and a second neck for fluid communication between the damper volume and the second damper volume, and the method comprises: feeding the purging fluid through a purge hole into the second damper volume.

* * * * *